US006836203B2

(12) United States Patent
Wada

(10) Patent No.: US 6,836,203 B2
(45) Date of Patent: Dec. 28, 2004

(54) IGNITION COIL FOR INTERNAL COMBUSTION ENGINE

(75) Inventor: Jyunichi Wada, Chita-gun (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/301,588

(22) Filed: Nov. 22, 2002

(65) Prior Publication Data

US 2003/0098764 A1 May 29, 2003

(30) Foreign Application Priority Data

Nov. 26, 2001 (JP) ..... 2001-359577

(51) Int. Cl.[7] ..... H01F 27/30
(52) U.S. Cl. ..... 336/198; 336/90
(58) Field of Search ..... 338/65, 90–96, 338/107, 110, 192, 198; 123/634, 635; 336/65, 90–96, 107, 110, 192, 198

(56) References Cited

U.S. PATENT DOCUMENTS 5,406,921 A * 4/1995 Noble et al. ..... 123/479
6,094,121 A * 7/2000 Sakamaki et al. ..... 336/96
6,192,873 B1 * 2/2001 Adachi et al. ..... 123/635
6,232,863 B1 * 5/2001 Skinner et al. ..... 336/96

FOREIGN PATENT DOCUMENTS

EP 0 703 588 A1 * 3/1996
JP 10-74648 3/1998
JP 11-186078 7/1999

* cited by examiner

*Primary Examiner*—Tuyen T. Nguyen
(74) *Attorney, Agent, or Firm*—Nixon & Vanderhye PC

(57) ABSTRACT

The ignition coil in this invention has a coil portion and a high voltage tower portion. The coil portion has a primary coil, a secondary coil, and a coil case. The high voltage tower portion has a high voltage spring which attaches to the terminal of the ignition plug under the coil in the central portion of the ignition coil. A feature of the ignition coil is that a secondary terminal composed of a connector portion connected with a secondary winding and an attaching portion directly attaches at the end of the high voltage spring under the coil portion. Since the secondary terminal functions as a terminal of the high voltage spring, the high voltage spring terminal, such as in the prior art, can be eliminated. An air outlet passage is also formed at the high voltage end of the secondary spool.

8 Claims, 4 Drawing Sheets

IGNITION COIL FOR INTERNAL COMBUSTION ENGINE

CROSS REFERENCE TO RELATED APPLICATION

This application is based on, claims the benefit of priority of, and incorporates herein by reference the contents of Japanese Patent Application No. 2001-359577 filed on Nov. 26, 2001.

BACKGROUND OF THE INVENTION

1. Field of the Invention

The present invention relates to an ignition coil for an internal combustion engine and a method of manufacturing the ignition coil.

2. Description of the Related Art

Generally, high voltage is supplied to an ignition plug from a mechanical distributor through a high voltage wire. A recently developed method has been employed in which the high voltage is supplied directly from an ignition coil, placed separately in each cylinder of an engine, to the ignition plug. The independent ignition coils equip a coil portion, which has a primary coil and a secondary coil for a step-up from a primary voltage to a secondary voltage, and a high voltage tower portion, which impresses the high voltage generated in the secondary coil on the ignition coil through a high voltage spring. The coil portion and the high voltage tower portion are manufactured separately, and they are attached together in an assembling step. Finally, a gap in them is filled with a filling material such as an epoxy resin and the ignition coil reaches completion.

For example, in JP-A-11-186078 the structure of the electrical connectors between the coil portion and the high voltage tower portion is shown in FIG. 5 and is designed as such because of its simple manufacturing method. The structure of FIG. 5 consists of a secondary terminal 329, which is connected to a secondary wiring of a secondary coil portion, a high voltage terminal 339, which is electrically connected to the secondary terminal 329, and a high voltage spring 338 of a high voltage tower portion, which maintains contact with the high voltage terminal 339.

However, since the secondary terminal and the high voltage terminal are used as additional parts in the FIG. 5 structure, the manufacturing cost is high. Moreover, increasing the number of parts causes increased complexity in the manufacturing method and an increase in the number of manufacturing steps.

SUMMARY OF THE INVENTION

The ignition coil in this invention is broadly composed of a coil portion and a high voltage tower portion. The coil portion has a primary coil, which is a primary spool wound by a primary winding, and a secondary coil, which is a secondary spool wound by a secondary winding concentrically with the primary coil. The ignition coil also has a coil case in which is stored the primary coil and the secondary coil. The high voltage tower portion has a tower case under the coil portion and an elastic connection member that is placed in the center of the tower case and which contracts the end f the ignition plug. In the ignition coil, which impresses a supply voltage to the prim coil and to the ignition plug in the secondary coil, a secondary terminal is equipped in e lower end of the coil portion. The secondary terminal has a connection portion for connection with the secondary wiring and a contact portion to contact directly with the end o the elastic contact member.

The ignition coil can eliminate a terminal of the high voltage spring needed in prior ignition coils, while permitting manufacturing at a low cost and in a simple structure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
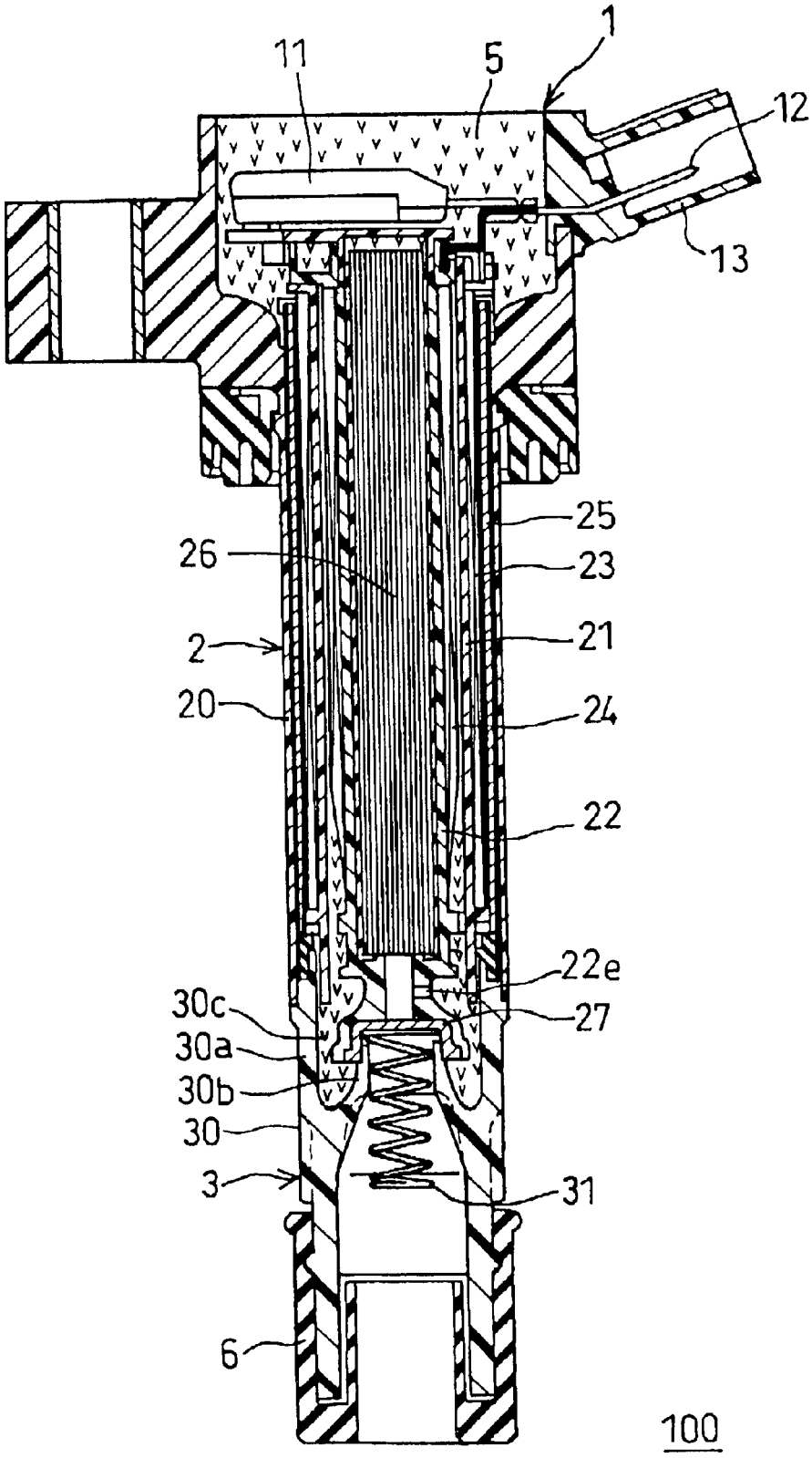
FIG. 1 is a cross-sectional view of a body of an ignition coil according to the present invention.

The following description of the preferred embodiments is merely exemplary in nature and is in no way intended to limit the invention, its application, or uses.

First Embodiment

An ignition coil 100 is referred to as a stick-type ignition coil and is installed in each plug hole of a cylinder in an engine block (not shown). The ignition coil 100 is broadly grouped under a control portion 1, a coil portion 2, and a high voltage tower portion 3.

The control portion 1 is composed of a terminal 12 inserted in a connector 13 and an igniter 11 connected with the terminal 12. An ignition signal from an ECU (not shown) is transmitted to the igniter 11 through the terminal 12. When the igniter 11 detects the ignition signal, the igniter 11 switches a primary current for a primary coil and causes an ignition plug to generate successive sparks.

The coil 2 is composed of a coil case 20 as a shell, an outer core 2 , a primary coil composed of a primary spool 21 and a primary winding 23, a secondary oil composed of a secondary spool 22 and a secondary winding 24, a central core 26 and so on. Because of them a magnetic circuit is formed, and a voltage (about 12 V) supplied to a primary coil is increased to a higher voltage (about 30 kV).

The high voltage tower portion 3 is composed of a cylindrical-shaped tower case 30, a high voltage spring 31, a rubber plug cap 6 attached at the end of the tower case 30 for the protection of the plug, and so on. After the high voltage tower portion 3 is attached in the coil portion 2, a resin insulator 5 made of an epoxy resin is completely filled from the top of the control portion 1. The resin insulator 5 passes through a gap between the primary spool 21 and the secondary spool 22 and fills a circular space 30*c* in the tower case 30. The resin insulator 5 functions as an insulator between the primary coil and the secondary coil, and fixes each member in the case 20.

Figure 2:
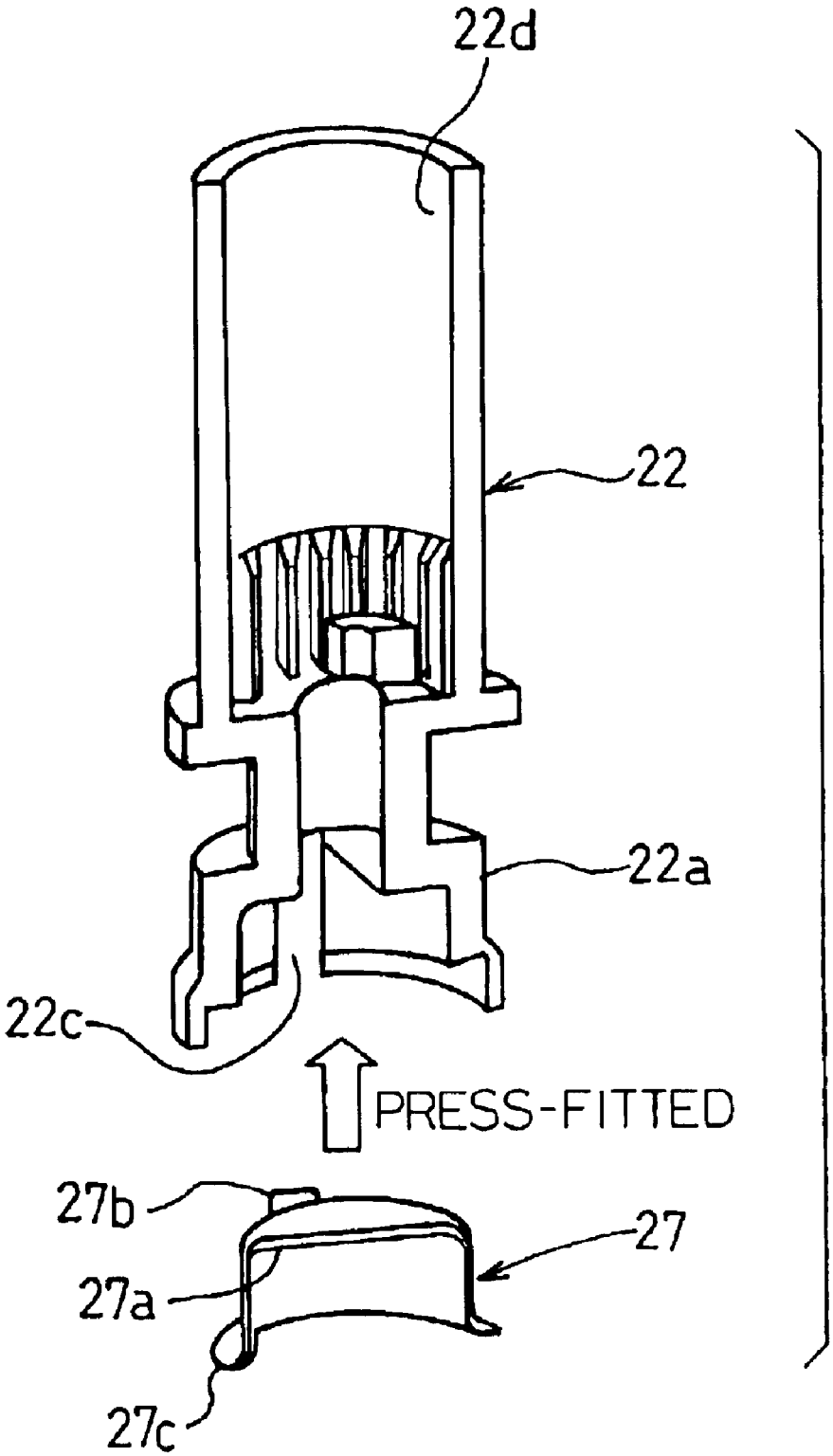
FIG. 2 is a perspective sectional view of a secondary spool and secondary terminal according to the first embodiment of the present invention.
Figure 4B:
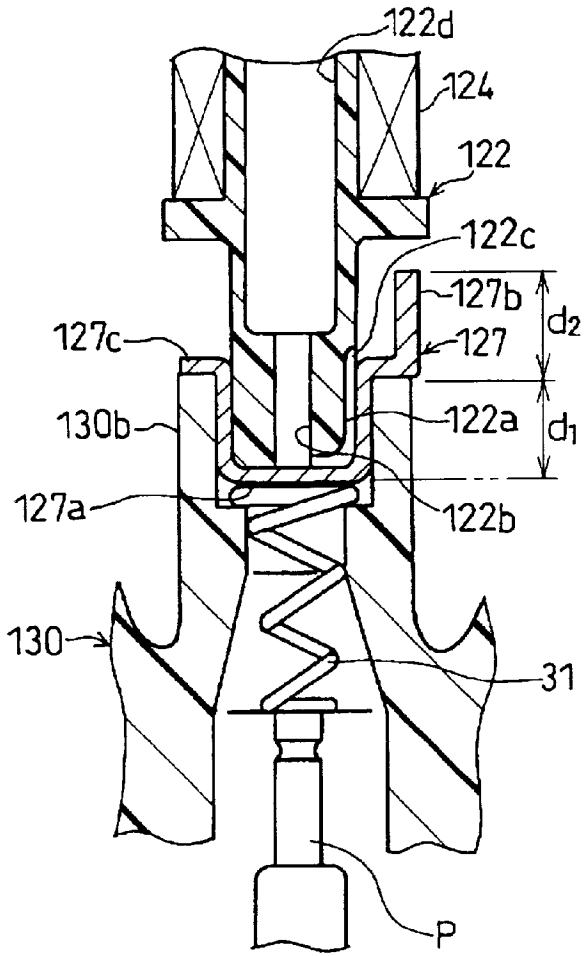
FIG. 4B is sectional view of a main part according to the second embodiment of the present invention.
Figure 4A:
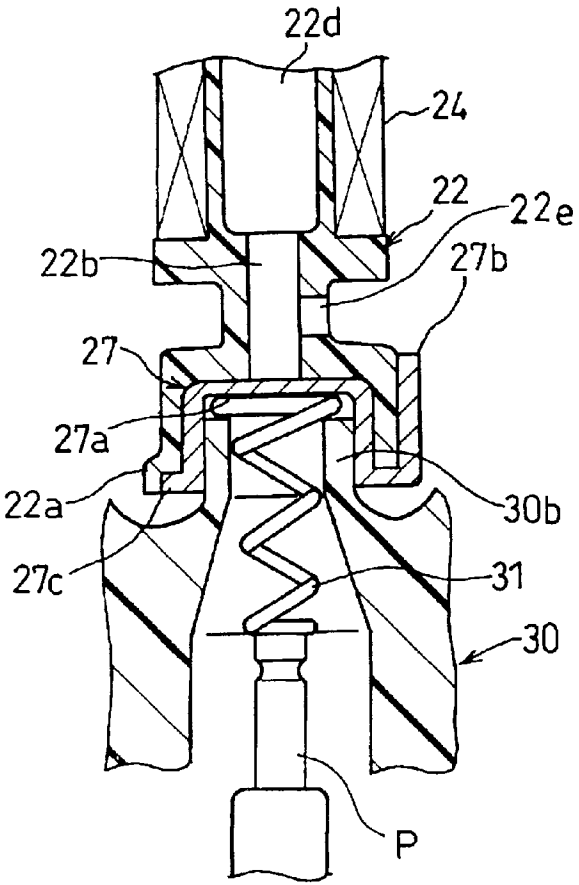
FIG. 4A is sectional view of a main part according to the first embodiment of the present invention.

Referring to FIGS. 2 and 4A, the secondary terminal 27 has a cup shape and has a small flange 27*c* at its rim. From a part of the flange 27*c*, a terminal projection 27*b* projects toward the top in FIG. 2. The projection 27*b* is soldered to the end of the secondary wiring 24. A bottom face 27*a* inside the secondary terminal 27 is a part for contacting the high voltage spring 31. The secondary terminal 27 can be formed easily by forming sheet metal. The high voltage spring 31, also known as an elastic contact terminal 31, installed in the center of the tower case 30 and used for contact with the ignition plug terminal P.

The secondary spool 22 has a cylindrical concave portion 22*a* to cover the second terminal 27. In the cylindrical concave portion, an opening 22*c* is formed. The terminal projection 27*b* of the secondary terminal 27 fits into the opening 22*c*. The secondary spool 22 has a cylindrical cover 22*d* to store the central core 26, and the cylindrical cover 22*d* and the concave portion 22*a* are connected through a passage 22*b*. The passage 22*e* is formed througt secondary spool 22 is formed due to a resin conforming around a support pin in a mold.

The secondary terminal 27 is pressed in the cylindrical concave portion 22*a* of the secondary spool 22 and fixed to complete the secondary coil. In the passage between the cylindrical cover 22*d* and the cylindrical concave portion 22*a*, a passage 22*e* for the epoxy resin is formed. The epoxy resin is poured from the outside and passes through passage 22*e* and passage 22*b*, and enters the second spool 22. As a result, the insulation between the secondary terminal and the central core 26 is maintained.

In the coil portion 2 assembled by the above method, the high voltage tower portion 3 is attached. The coil case 20 and the outer cylindrical portion 30*a* of the tower case 30 are attached together by an adhesive. The secondary terminal 27 is pressed in the inner cylindrical portion 30*b* of the tower case 30 and fixed. In this assembly, a spring 31 having a large upper diameter, is attached in advance. By that, the high voltage spring 31 is supported at the upper part of the inner cylindrical portion 30*b*, and does not fall down. That is shown in FIG. 4A.

Finally, the resin insulator 5 is filled from the outside. At this time, a seal is effected at the joint formed between the secondary terminal 27 and the inner cylindrical portion 30*b* of the tower case 30. By virtue of that sealed connection, a resin insulator 5 filled in the circular space 30*c* does not leak from the tower case 30. Otherwise, the gap of opening 22*c* is not completely closed by the secondary terminal 27 and the terminal projection 27*b*. From the gap, the resin insulator 5 enters inside cylindrical cover 22*d* through the secondary spool 22 and the passage 22*d*. That is, the central core 26 in the cylindrical cover 22*d* is fixed by the resin insulator 5.

Second Embodiment

Figure 3:
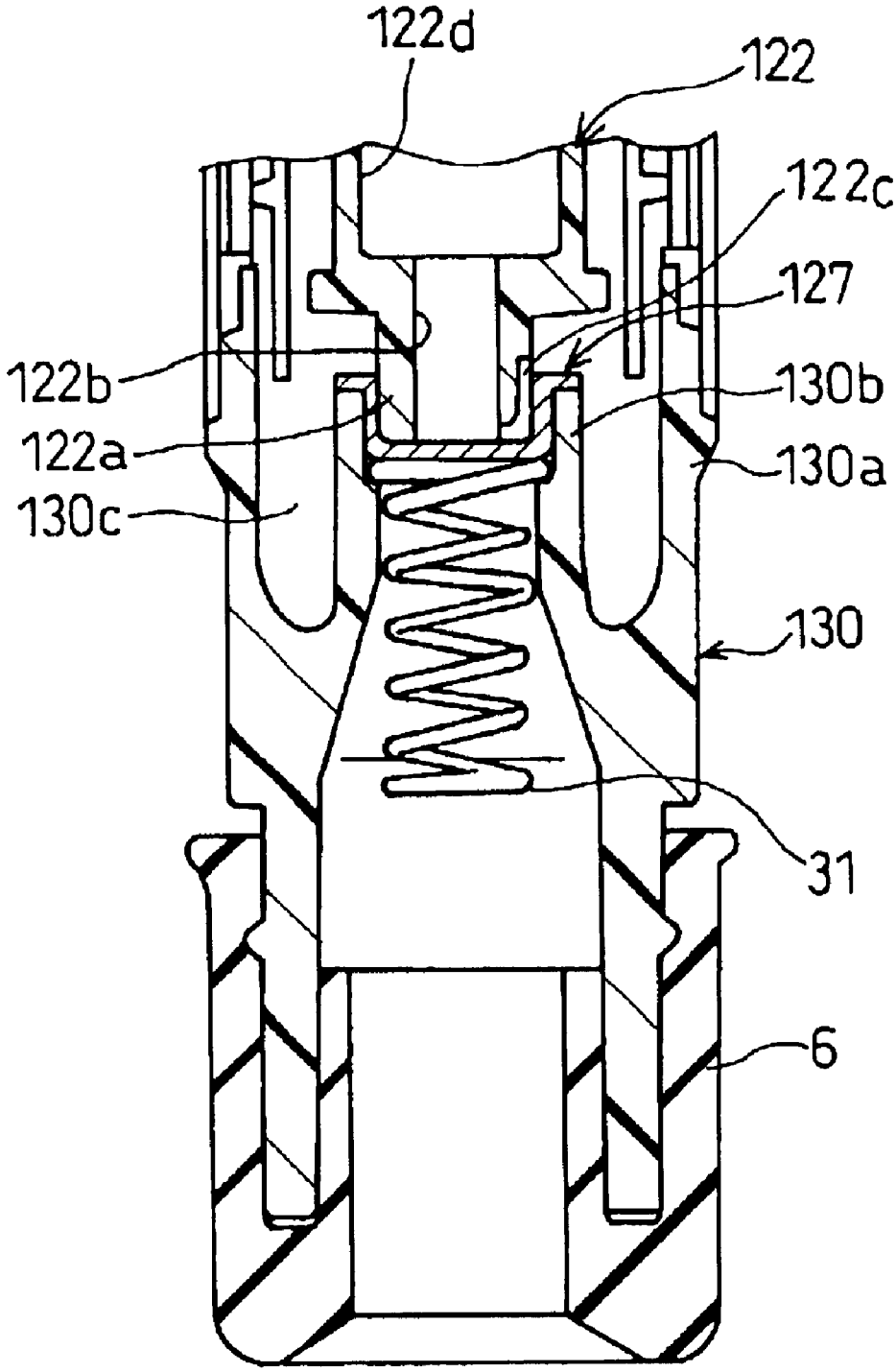
FIG. 3 is a sectional view around the secondary terminal according to the second embodiment of the present invention.
Figure 5:
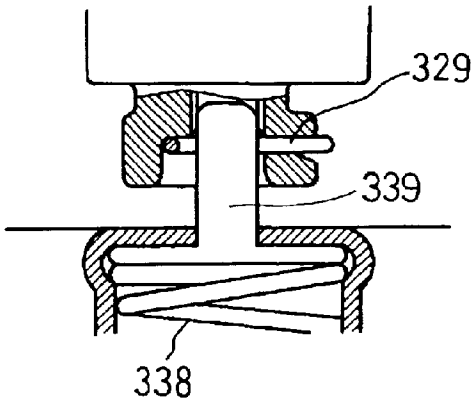
FIG. 5 PRIOR ART
FIG. 5 is a sectional view of a secondary terminal and a high voltage terminal according to the prior art.

Referring to FIG. 3 and FIG. 4B, a secondary terminal 127 has a cylindrical shape with a small flange 127*c* at its rim. A terminal projection 127*b* projects from a part of the flange 127*c*. With the terminal projection 127*b*, the end of the secondary wiring 124 is soldered. A bottom surface 127*a* outside the secondary terminal 127 is a part that contacts the end of the high voltage spring 31.

The secondary spool 122 has a cylindrical projection 122*a* and is inserted in the secondary terminal 127. However, in the central portion of the cylindrical projection 122*a*, a passage 122*b* connected by a cylindrical cover 122*d* is formed. The passage 122*b* is formed when the secondary spool 122 is formed by a resin conforming around a support pin in a mold.

The secondary spool 122 is pressed in the secondary terminal 127 and fixed. Around the surface of the projection 122*a*, there is a passage 122*c*. The passage 122*c* is formed in a step-wise fashion along the secondary terminal 127. By the passage 122*c* and the secondary terminal 127, a passage for epoxy resin is formed.

A high voltage tower portion 3 is attached to the coil portion 2 and assembled by the above method. The tower case 130 is pressed in the secondary terminal 127 and fixed. Since the inside of the inner cylindrical portion 130*b* has a step, the large diameter part of the high voltage spring 31 is fixed at the step.

A circular space 130*c* is filled with the resin insulator 5. The circular space 130*c* is formed between the inner cylindrical portion 130*b* and the outer cylindrical portion 130*a*. However, in this embodiment, where the outer surface of the secondary terminal 127 contacts the inner surface of the cylinder portion 130*b* of the tower case a sealed connection is formed. When the core space or the opening connected to the passage 122*b* are formed, the resin insulation 5 fills in the secondary spool 122 while the central core 26 is fixed by the resin insulator 5.

The first embodiment as shown in FIG. 4A is shorter than the second embodiment as shown in FIG. 4B with respect to the direction of the longitudinal axis. Specifically, the secondary spool 22 in the first embodiment is shorter than the secondary spool 122 in the second embodiment by at least the length of the terminal projection 127*b*. Structurally, the ignition coil in the first embodiment can be manufactured as a shorter unit with respect to the direction of the longitudinal axis than that in the second embodiment. Additionally, when the lengths in the direction of the longitudinal axis are the same, the apparatus of the first embodiment can be manufactured with a smaller diameter and a higher performance than the apparatus in the second embodiment.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ignition coil comprising:

a coil portion, including:

(a) a primary coil, further including:

(a)(i) a primary spool; and (a)(ii) a primary winding wound on the primary spool;

(b) a secondary coil installed concentrically with the primary coil, further including:

(b)(i) a secondary spool having a passage formed along the side of a bottom area thereof, which communicates between the inside of the secondary spool and the outside thereof, and through which resin easily passes to fill a space of the secondary spool; and (b)(ii) a secondary winding wound on the secondary spool;

(c) a coil case accommodating the primary coil and the secondary coil;

(d) a high voltage tower, including:

a tower case connected to and under the coil case;

(e) an elastic contact terminal installed in the center of the tower case and used for contact with an ignition plug terminal; and (f) a secondary terminal, which has a bottom surface, located under the coil case, and including:

a connector for the secondary winding;

a portion contacting an end of the elastic contact terminal, and pressed and fixed with respect to at least one of the primary spool or the secondary spool.

2. An ignition coil as in claim 1, wherein the secondary terminal is pressed and fixed into and thereby fixed in a lower portion of the secondary spool.

3. An ignition coil as in claim 2, wherein the tower case further comprises:

an outer cylinder connected to the coil case;

an inner cylinder having the elastic contact terminal pressed and fixed in the secondary terminal; wherein the outer cylinder and the inner cylinder are attached to each other at coincident ends;

the inner cylinder and the secondary terminal being attached so as to effect a sealed joint therebetween; and a circular space defined by the tower case that can be filled with filling material.

4. An ignition coil as in claim 2, wherein the secondary terminal is pressed and fixed in a concave portion formed in a lower portion of the primary spool or in a lower portion of the secondary spool, and has a cylindrical shape with an inner bottom face that is a connection terminal.

5. An ignition coil as in claim 2, wherein the secondary terminal is pressed and fixed in a projection formed in the lower end of the primary spool or the secondary spool and has a cylindrical shape with a bottom surface which is a connection surface.

6. An ignition coil as in claim 4, wherein the connector of the secondary terminal is a portion extending therefrom in a bent fashion.

7. An ignition coil as in claim 1 wherein said secondary terminal is connected with the secondary winding on one end, and is pressed by the elastic contact terminal on the other end, the secondary terminal directly contacting the elastic contact terminal at a solid area without a penetrating hole.

8. An ignition coil comprising:

a coil case in which is disposed a primary coil spool and a concentric secondary coil spool;

said case having a low voltage terminal at one end and a high voltage terminal at an opposite end;

a secondary terminal including a portion pressed and fixed with respect to at least one of the primary spool or the secondary spool; and a through hole in said secondary coil spool at its high voltage end to facilitate passage of air and/or resin therethrough during resin filling of a space between said concentric spools while said secondary terminal is in place.

* * * * *